US007621349B2

(12) United States Patent
Da Silva et al.

(10) Patent No.: US 7,621,349 B2
(45) Date of Patent: Nov. 24, 2009

(54) DRILL BIT WITH A FIXED CUTTING STRUCTURE

(75) Inventors: Nuno Da Silva, Brussels (BE); Nicolas Luyckx, Mons (BE)

(73) Assignee: Halliburton Energy Services, Inc., Drogenbos (BE)

( * ) Notice: Subject to any disclaimer, the term of this patent is extended or adjusted under 35 U.S.C. 154(b) by 0 days.

(21) Appl. No.: 11/816,808

(22) PCT Filed: Feb. 23, 2005

(86) PCT No.: PCT/BE2005/000028

§ 371 (c)(1),
(2), (4) Date: Aug. 30, 2007

(87) PCT Pub. No.: WO2006/089379

PCT Pub. Date: Aug. 31, 2006

(65) Prior Publication Data

US 2008/0135306 A1 Jun. 12, 2008

(51) Int. Cl.
*E21B 21/00* (2006.01)
*E21B 10/36* (2006.01)

(52) U.S. Cl. ..... 175/393; 175/426; 175/430; 175/431; 175/432; 175/434

(58) Field of Classification Search ..... 175/393, 175/405.1, 412, 434, 426, 430, 431, 432, 175/327
See application file for complete search history.

(56) References Cited

U.S. PATENT DOCUMENTS 1,961,390 A 6/1934 Ragsdale ..... 255/61
2,290,595 A * 7/1942 Kinnear ..... 175/379
2,976,927 A * 3/1961 Kammerer, Jr. et al. .... 166/55.8
3,095,053 A * 6/1963 Pistole et al. ..... 175/327
3,106,973 A 10/1963 Christensen ..... 175/413
3,163,246 A 12/1964 Vagins et al. ..... 175/410
3,599,736 A * 8/1971 Thompson ..... 175/434

(Continued)

FOREIGN PATENT DOCUMENTS

DE 29611966 11/1997

(Continued)

OTHER PUBLICATIONS

U.S. Appl. No. 60/644,369, filed Jan. 2005, Lapointe, Paul-Philippe.*

(Continued)

*Primary Examiner*—Jennifer H Gay
*Assistant Examiner*—Yong-Suk Ro
(74) *Attorney, Agent, or Firm*—Baker Botts L.L.P.

(57) ABSTRACT

The invention concerns a drill bit (1) with stationary cutting structure, comprising a tool body (2) and several blades (3), which consist of a metal matrix impregnated with abrasive particles, and which are fixed to the tool body while extending forward therefrom, said blades (3) forming jointly a front cutting surface (7), and having radial channels (4) for drilling fluid which mutually separate the blades (3) and are open outwards. The invention is characterized in that it further comprises, through at least one radial fluid channel (2) arranged between two said blades (3), at least one bridge (6, 6', 6") which connects said two blades, by being arranged between the tool body (2) and said front cutting surface (7).

19 Claims, 3 Drawing Sheets

U.S. PATENT DOCUMENTS

| | | | | |
|---|---|---|---|---|
| 4,440,247 | A | 4/1984 | Sartor | 175/393 |
| 4,883,132 | A | 11/1989 | Tibbitts | 175/65 |
| 6,454,030 | B1 * | 9/2002 | Findley et al. | 175/425 |
| 2008/0066969 | A1 * | 3/2008 | Paul-Philippe | 175/405.1 |

FOREIGN PATENT DOCUMENTS

| | | |
|---|---|---|
| DE | 19712181 | 1/1998 |
| SU | 929806 | 5/1982 |

OTHER PUBLICATIONS

International Search Report for Application No. PCT/BE2005/000028 (6 pages), Oct. 13, 2005.

* cited by examiner

DRILL BIT WITH A FIXED CUTTING STRUCTURE

The present invention relates to a drill bit with a fixed cutting structure, comprising a tool body, and several blades, which include a metal matrix impregnated with abrasive particles and which are fixed to the tool body while extending forward from this, these blades forming conjointly a front cutting face and having radial passages for a drilling fluid that mutually separate the blades and are open towards the outside (see for example U.S. Pat. No. 6,725,953).

Two classes of tool are used in oil drilling: rolling-cutter bits on the one hand and fixed-blade bits on the other.

Rolling-cutter bits are assemblies comprising a moving part while fixed-blade tools are in a single piece, without any moving part.

In the class of bits with a fixed cutting structure, four sub-categories can be distinguished, which are differentiated by the nature of their cutting structure. The latter can be composed of PDC (polycrystalline diamond compacts), natural diamonds, TSP (thermally stable polycrystalline diamond) or a metal material impregnated with diamonds or other abrasive particles. It is this last category that forms the field of application of this invention. The tools concerned are designed to drill hard abrasive rocks. The blades of the tool are supported by the tool body. This includes a metal matrix and a steel core.

The invention can also be applied to core bits whose main cuffing structure is made from impregnated diamond.

The blades of impregnated tools include a mixture of metal and abrasive particles. During drilling, the metal binder cutting the particles and these abrasive particles themselves wear, thereby exposing new particles. As the tool wears, the blade height decreases.

There is therefore every advantage in having at the start drill bits having a blade height as great as possible. The drawback is that the impregnating material is fragile. The blades are therefore subject to breaking. This phenomenon increases with the blade height. For a given tool configuration, there therefore exists a limit to the height of the blades beyond which there is a high risk of mechanical breaking.

The aim of the present invention is to propose drill bits with blades made from an impregnated material having great blade heights, which are capable of overcoming the aforementioned drawbacks, and therefore whose service life is thus increased.

This problem has been resolved according to the invention by a drill bit, as indicated at the start, which also comprises, through at least one radial passage for fluid disposed between two aforementioned blades, at least one bridge that connects these two blades, while being arranged between the tool body and said front cutting face. The blades of these tools made from impregnated material are thus reinforced mechanically, which makes it possible to design higher blades. And higher blades make it possible to increase the quantity of diamond on the tool and therefore to increase its service life and the length drilled by means of the tool.

Bridges through radial passages for a fluid should be taken to mean elements that do not prevent the flow of fluid in these passages.

Advantageously, it is even possible to provide several bridges per passage and bridges in several passages, possibly but not necessarily in each of them.

According to one embodiment of the invention, each bridge is arranged inside an aforementioned radial passage. It may be preferable for the bridges not even to fit flush with the external surface of the blades in order to preserve their mechanical action as long as possible.

The bridges can be fabricated by any usual method known to persons skilled in the art and from any material suitable for this type of method.

As is known, bits with blades including an impregnated metal matrix are moulded, a metal powder with abrasive particles added filling the mould, then being infiltrated by a suitable known liquid solder.

The bridges can be fabricated before filling the mould or on the other hand after infiltration and removal from the mould.

According to one embodiment of the invention, each bridge includes an insert based on a sintered metal powder that has been inserted, before moulding of the bit, in a cavity formed in a piece forming, during moulding, one of said passages for a fluid, and that has been infiltrated with liquid solder.

According to another embodiment of the invention, each bridge includes an insert based on a metal powder pre-formed using a binder that has been inserted, before moulding of the bit, in a cavity formed in a piece forming, during moulding, one of said passages for a fluid, that has had the binder removed by heat treatment, and that has been infiltrated with liquid solder.

According to yet another embodiment of the invention, each bridge consists of metal or non-metal powder that has been introduced, before moulding of the bit, in a cavity formed in a piece forming, during moulding, one of said passages for a fluid, and that has been infiltrated with liquid solder.

According an improved embodiment of the invention, each bridge includes paste based on metal or non-metal powder with at least one organic additive added, that has been introduced, before moulding of the bit, in a cavity formed in a piece forming, during moulding, one of said passages for a fluid, that has had said at least one organic additive removed by heat treatment, and that has been infiltrated with liquid solder.

The metal powder used is known per se and can for example be based on tungsten, nickel or the like. It can advantageously itself contain particles that are hard and/or resistant to abrasion, such as diamond, carbide, etc particles.

The sintered pieces, diamond-impregnated or not, can be dense or not. The preformed pieces are bound by means of any known binder, for example paraffin that is eliminated by the heat treatment before infiltration.

The pastes consist of a pasty mixture of powder as indicated above, with organic additives, such as lubricants, plasticisers or the like, a mixture that is easy to shape. Through the heat treatment before infiltration, the additives are eliminated.

The diamonds used are natural or synthetic. They can have any type of granulometry, monomodal or multimodal. They can be of the Grid or ground TSP type. They are used for example at concentrations of 1 to 40% by weight with respect to the powder.

As the non-metallic powder, tungsten carbide can for example be provided.

As solder, a copper-based alloy can advantageously be used.

According to another embodiment of the invention, each bridge consists of a strut made from sintered material, diamond-impregnated or not, made from steel, carbide or similar material, which, after the bit is removed from the mould, has been fixed to the blades in one of said passages for fluid. The struts forming a bridge are fixed to the blades by any suitable means, for example by brazing, crimping, welding or adhesive bonding.

Other details and particularities of the invention will emerge from the description given below, with reference to the accompanying drawings, of an example embodiment of a drill bit according to the invention.

In the various drawings, the identical or similar elements bear the same references.

Figure 2:
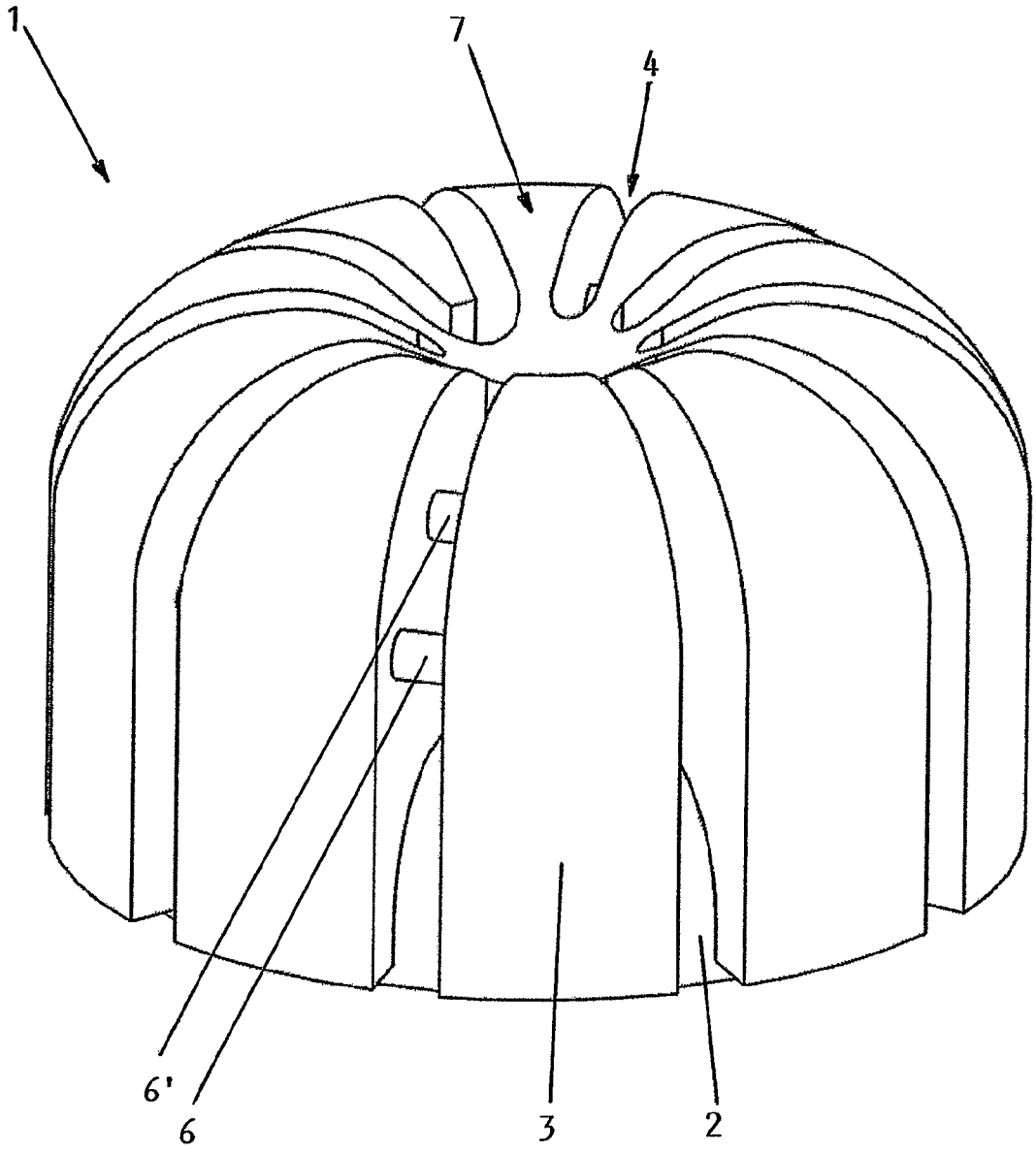
FIG. 2 depicts a view of FIG. 1 in isometric perspective.

One example embodiment, given non-limitatively, of the drill bit according to the invention has been illustrated in these drawings. This drill bit 1 comprises a tool body 2 in several cutting blades 3 that are formed from a metal matrix impregnated with abrasive particles, for example diamond. The blades 3 are fixed to the tool body in a normal manner and, is clear in particular from FIG. 2, they extend forwards, over a relatively great height, from the cutting body 2. They thus form at their free end a front cutting face 7. Between these blades 3 there are arranged radial passages for a fluid 4 that mutually separate the blades and are open towards the outside. The cutting body is provided with a central conduit 5 through which a drilling fluid emerges from the bottom of the radial passages 4.

Figure 1:
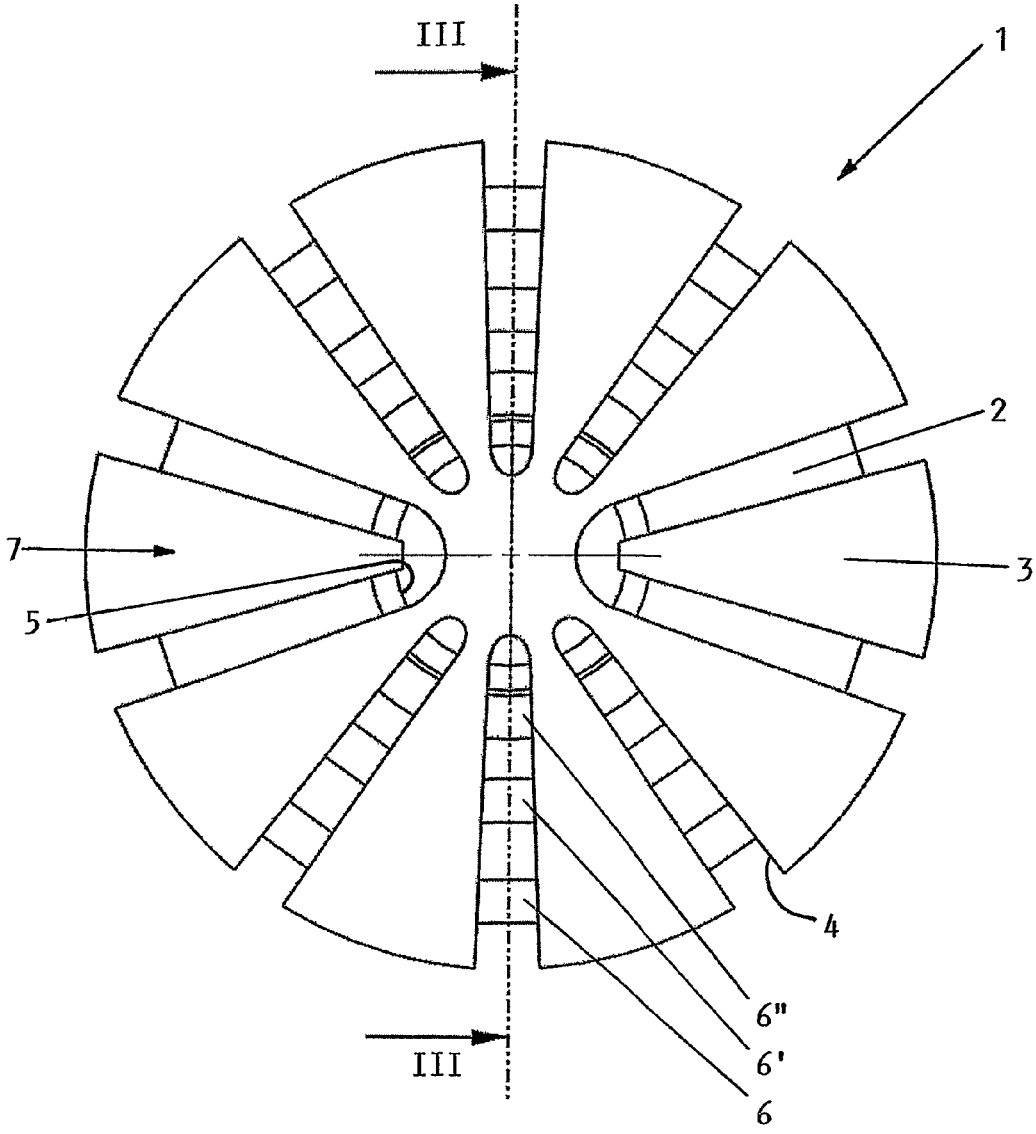
FIG. 1 depicts a plan view of a drill bit according to the invention.
Figure 3:
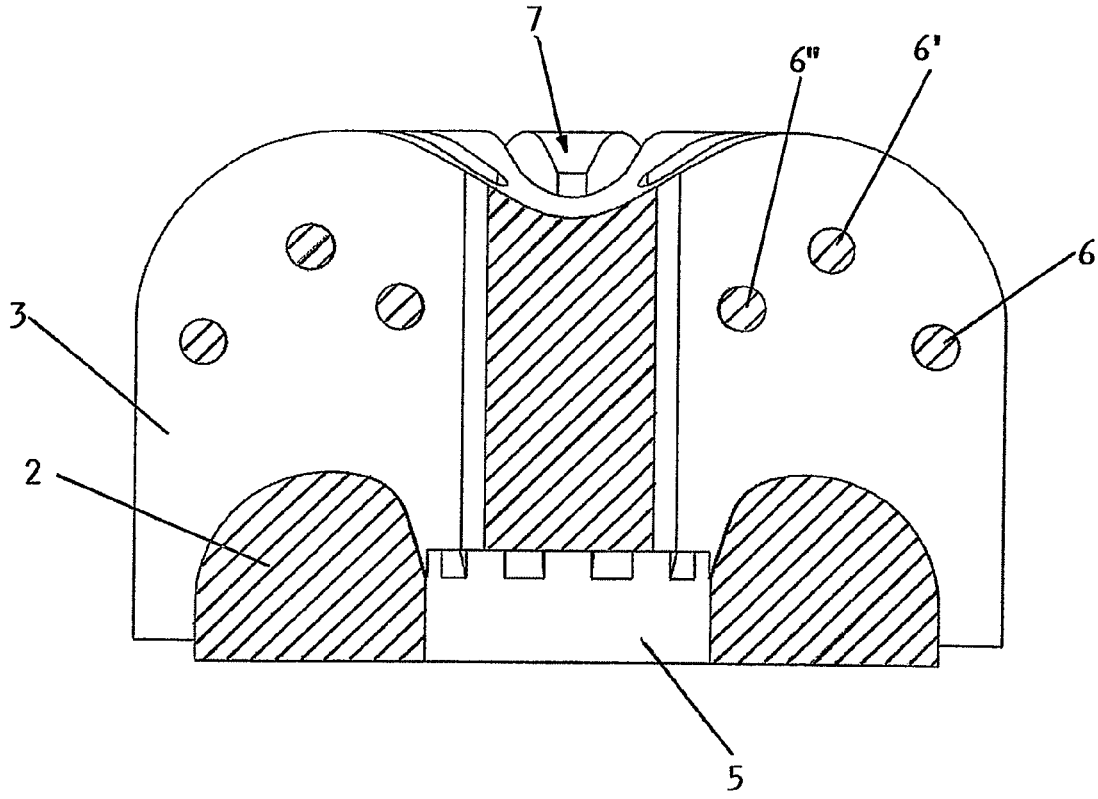
FIG. 3 depicts a view in section along the line III-III in FIG. 1.

As can be seen in FIG. 1, six of the ten radial passages 4 of the drill bit are provided, through these, with three bridges 6, 6', 6" that each connect two adjoining blades 3. As is clear from FIGS. 2 and 3, these bridges are arranged between the tool body 2 and the front face 7 of the blades. Advantageously, these bridges are situated at different heights and thus make it possible to mechanically reinforce the blades, which are highly stressed during drilling, without completely interfering with the passage of fluid, nor reducing its lubrication and cooling action.

As shown, the bridges are arranged inside the fluid passages and thus prevent premature wear on the bridges, as would happen if they were situated projecting or flush with the blades.

However, through a judicious choice of the composition of the bridges; this being able for example to be of the same type as the blades, it is possible to provide, after an initial wear on the blades, for the bridges themselves to participate in the abrasive action during drilling and to be worn in their turn. Hence the advantage of providing several bridges stepped at different heights in the fluid passages.

Preferably, as illustrated, the bridges have a tubular, cylindrical or conical shape, the axis of which is oriented tangentially to the direction of rotation of the blades during drilling.

It must be understood that the present invention is in no way limited to the embodiment described above and that many modifications can be made thereto without departing from the scope of the accompanying claims.

What is claimed is:

1. A drill bit (1) with a fixed cutting structure, comprising:

a tool body (2) including a central conduit for a drilling fluid;

several blades (3), which include a metal matrix impregnated with abrasive particles and which are fixed to the tool body while extending forwards from the tool body;

the blades (3) forming conjointly a front cutting face (7), and having radial passages (4) for a drilling fluid that mutually separate the blades (3) and are open towards the outside of the tool body wherein the radial passages each have a bottom connected to the central conduit to allow the drilling fluid to emerge from the bottoms of the radial passages; and several bridges (6, 6', 6") disposed inside at least one radial passage (4) for a fluid disposed between two aforementioned blades (3), wherein said bridge connects these two blades, while being disposed between the tool body (2) and the-front cutting face (7).

2. The drill bit according to claim 1, further comprising the several of the bridges (6, 6', 6") disposed in said at least one radial passage (4).

3. The drill bit according to claim 1, wherein each bridge further comprises:

an insert based on a metal powder preformed using a binder, which has been inserted, before moulding of the drill bit, in a cavity formed in a piece forming, during moulding, one of said radial passages;

the binder removed from the insert by heat treatment; and the metal powder infiltrated with liquid solder.

4. The drill bit according to claim 1, wherein each bridge further comprises:

a metal or non-metal powder that has been introduced, before moulding of the drill bit, into a cavity formed in a piece forming, during moulding, one of said radial passages; and the metal or non-metal powder infiltrated with liquid solder.

5. The drill bit according to claim 1, wherein each bridge further comprises:

a paste based on a metal or non-metal powder and at least one organic additive;

the paste introduced before the moulding of the drill bit, into a cavity formed in a piece forming, during moulding, one of said radial passages, said at least one organic additive removed from the paste by heat treatment; and the paste infiltrated with liquid solder.

6. The drill bit according to claim 1, wherein each bridge further comprises a strut made from diamond-impregnated sintered material selected from the group consisting of steel, carbide and similar material, which, after the drill bit has been removed from the mould, has been fixed to the blades in one of said radial passages.

7. The drill bit according to claim 1, wherein each bridge further comprises an insert formed at least in part from a metal powder having hard particles.

8. The drill bit according to claim 1, wherein each bridge further comprises a strut made from sintered material selected from the group consisting of steel, carbide or similar materials, which, after the drill bit has been removed from the mould, has been fixed to the blades in one of said radial passages.

9. The drill bit according to claim 1, wherein each bridge further comprises an insert formed at least in part from a metal powder having particles resistant to abrasion.

10. A drill bit (1) with a fixed cutting structure; comprising:

a tool body (2) including a central conduit for a drilling fluid;

several blades (3), which include a metal matrix impregnated with abrasive particles and which are fixed to the tool body while extending forwards from the tool body;

the blades (3) forming conjointly a front cutting face (7), and having several radial passages (4) for a drilling fluid that mutually separate the blades (3) and are open towards the outside of the tool body wherein the radial passages each have a bottom connected to the central conduit to allow the drilling fluid to emerge from the bottoms of the radial passages and;

several bridges (6, 6', 6") each disposed inside at least one of several radial passage (4) for a fluid disposed between two aforementioned blades (3), wherein each bridge connects these two blades, while being arranged between the tool body (2) and said front cutting face (7);

wherein each radial passage contains at least one bridge.

11. The drill bit according to claim 10, wherein each bridge further comprises an insert based on a sintered metal powder that has been inserted, before moulding of the drill bit, in a cavity formed in a piece forming, during moulding, one of said radial passages, and has been infiltrated with liquid solder.

12. Drill bit according to claim 11, further comprising the metal powder containing hard particles.

13. Drill bit according to claim 11, further comprising the metal powder containing particles resistant to abrasion.

14. The drill bit according to claim 10, further comprising;

each bridge having an insert based on a metal powder preformed using a binder;

the metal powder has been inserted, before moulding of the drill bit, in a cavity formed in a piece forming, during moulding, one of said radial passages;

the binder removed from the insert by heat treatment; and the metal powder infiltrated with liquid solder.

15. The drill bit according to claim 10, further comprising:

each bridge having a powder selected from the group consisting of metal or non-metal;

the powder introduced, before moulding of the drill bit, into a cavity formed in a piece forming, during moulding, one of said radial passages; and each bridge infiltrated with liquid solder.

16. The drill bit according to claim 10 wherein each bridge further comprises:

a paste based a powder selected from the group consisting of metal and non-metal and at least one organic additive disposed in the powder;

the paste introduced before the moulding of the drill bit, into a cavity formed in a piece forming, during moulding, one of said radial passages;

said at least one organic additive removed by heat treatment; and the paste infiltrated with liquid solder.

17. The drill bit according to claim 10 wherein each bridge further comprises a strut made from diamond-impregnated sintered material including steel, carbide or similar material, which, after the drill bit has been removed from the mould, has been fixed to the blades in one of said radial passages.

18. The drill bit according to claim 10 wherein each bridge further comprises a strut made from sintered material including steel, carbide or similar materials, which, after the drill bit has been removed from the mould, has been fixed to the blades in one of said radial passages.

19. The drill bit according to claim 10, further comprising several of the bridges (6, 6', 6") all disposed in at least one of the several radial passages (4).

* * * * *